United States Patent [19]

Siegel

[11] Patent Number: 4,458,766

[45] Date of Patent: Jul. 10, 1984

[54] HYDROJET DRILLING MEANS

[76] Inventor: Gilbert Siegel, 12282 Moana Way, Garden Grove, Calif. 92640

[21] Appl. No.: 419,799

[22] Filed: Sep. 20, 1982

[51] Int. Cl.[3] ..... E21B 10/60

[52] U.S. Cl. ..... 175/25; 175/67; 166/242

[58] Field of Search ..... 175/25, 65, 67, 422; 166/222, 223, 242; 299/17

[56] References Cited

U.S. PATENT DOCUMENTS 3,547,191 12/1970 Malott ..... 166/223

3,844,362 10/1974 Elbert et al. ..... 175/65 X

OTHER PUBLICATIONS

Brook et al., First International Symposium on Jet Cutting Technology, 5th–7th, Apr. 1972, Paper B1 and B9.

Summers et al., Third International Symposium on Jet Cutting Technology, 11th–13th, May 1976, Chicago, USA, Paper E2.

*Primary Examiner*—James A. Leppink

*Assistant Examiner*—Thuy M. Bui

*Attorney, Agent, or Firm*—Robert L. Sassone

[57] ABSTRACT

Hydrojet drilling means and method are presented. The method varies the angle and direction from which fluid contacts the material to be cut. The variation in angle and direction also causes the fluid to be applied to selected points and then repeatedly reapplied from different angles and directions getting the advantages of pulsed hydrojet cutting. As a result, 10,000 psi fluid streams cut as well in certain strata as prior art 50,000 psi hydrojets. The means comprises a recyclable fluid supply, means to clean the fluid stream, stringer means which may comprises as little as a cable with the associated fluid flow and power flow lines, a down hole pressure intensification means, and a drill head disposed about an axis formed by the stringer having at least three orifices disposed at equal angles about the axis. In operation, the drill head both rotates and is swung in a complex three dimensional selected series of pendulum-like arcs as the drill head is lowered. Cuttings are removed by prior art mucking means.

35 Claims, 15 Drawing Figures

FIG. 3
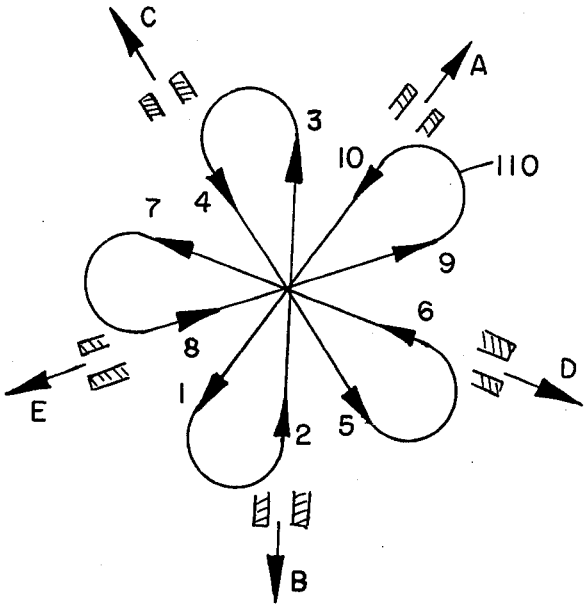
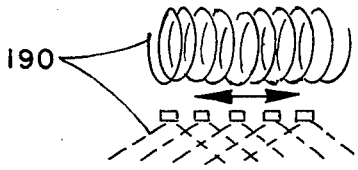
FIG. 3C
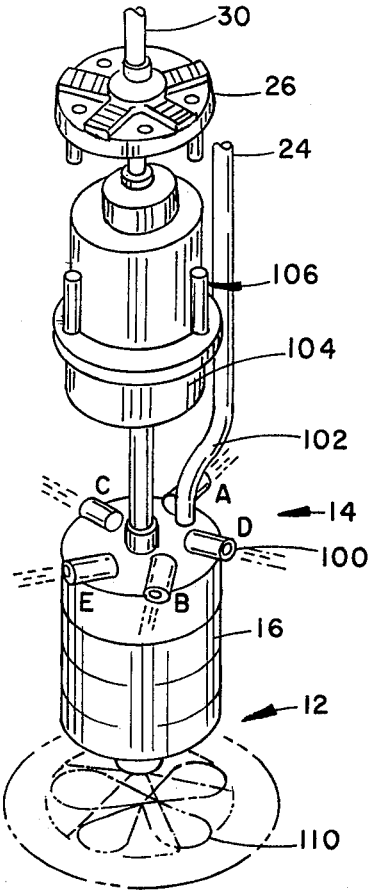
FIG. 3A
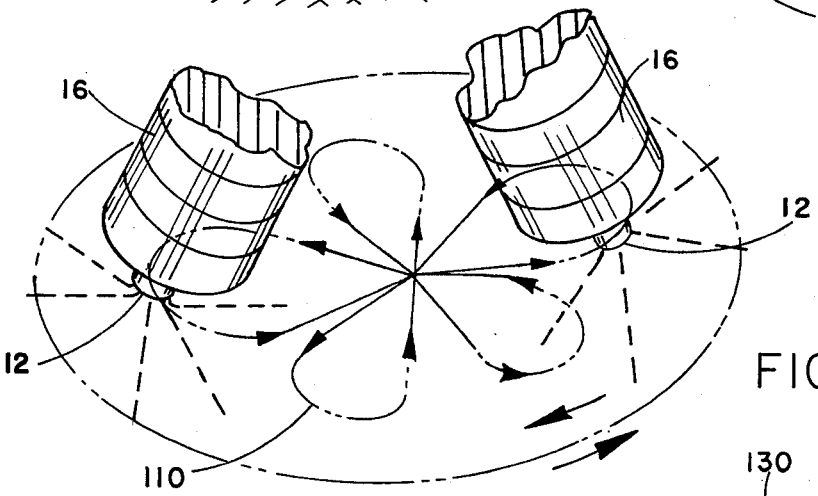
FIG. 3B
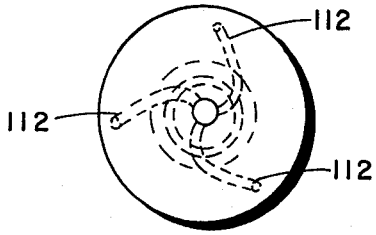
FIG.4
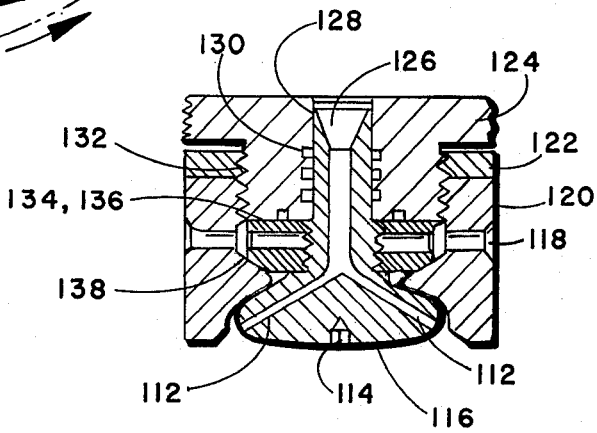
FIG.5

HYDROJET DRILLING MEANS

BACKGROUND OF THE INVENTION

1. Field of the Invention

The present invention relates to drilling means utilizing fast moving tightly focused streams of a fluid such as water.

2. Description of the Prior Art

To the layman, "drilling" conjurs up a picture of a metal cylinder having cutting edges. Speed boat races have familiarized interested members of the public with the concept that at the speeds boats currently race, approximately 100–200 miles per hour, water can be considered for many purposes to have many of the characteristics of a solid. This was characterized by one racer in the following manner: "If you hit the water in the wrong way at high speeds, it's about as soft as hitting a brick wall."

Water has long been used for moving solids in selected manners. Among the well known uses over the past years have been sprays used to clean dishes, sprays used by dentists to clean mouths, and the home use water-pik.

Beginning primarily in the 1970s, a substantial amount of research has been done in boosting the pressure used to force water through relatively small orifices. Pressures as high as 50,000 psi have been obtained under laboratory conditions, which pressures have forced water through relatively tiny orifices at speeds in excess of the speed of sound in air at sea level to penetrate and fragment rock, concrete and similar materials. A partial list of hydrojet references includes:

1. N. Brooks, PhD., Sc. (eng), E. ENG., E. H. Page, PhD.m,B.Sc. (mining), "Energy Requirements for Rock Cutting by High Speed Water Jets," Dept. Mining and Mineral Sciences, Leads Univ., U.K. 1972 (energy, rock removal rates, jet traverse rates, high pressure jets).

2. J. H. Olson, PhD., "Jet Slotting of Concrete," Flow Research, Inc., USA, 1974, (Approx. weights of high pressure equipment, kerf-cutting depth, advance rate, stagnation pressure.)

3. Labus, T. J., Silks, W. M., "A Hydraulic Coal Mining Machine for Room and Pillar Applications", IIT Research Institute, USA (T. J. Labus); Goodman Equipment Corp., USA (W. M. Silks) 1976. (Total assembly and equipment selections).

4. Summers, D. A., B.Sc., PhD. C Eng., MIMM, D. J. Bushnell, PhD., "Preliminary Experimentation for the Design for the Water Jet Drilling Device", Univ. of Missouri-Rolla, USA, 1976 (Cutting attitude to bedding plane, nozzle angles, rotational r.p.m. feed rate, pressure, depth of penetration.)

5. Labus, T. J. "Energy Requirements for Rock Penetration by Water Jets," IIT Research Inst., USA, 1976 (Traverse rate, wall interaction, rock characteristics, specific impulse pressure).

6. Hilaris, J. A., Labus, T. J., "Highway Maintenance Application of Jet Cutting Technology," ITT Research Inst., USA (Hilaris, J. A.) and SCTRE Corp., USA (Labus, T. J.) 1978. (Nozzle geometry, multiple pass cutting, comparison with mechanical cutting).

7. Summers, D. A. and Lehnoff, T. F. and Weakly, L. A., "The Development of a Water Jet Drilling System and Preliminary Evaluations of its Performance in a Stress Situation Underground", Univ. of Missouri-Rolla, USA (Summers D. A. and Lehnoff, T. F.) St. Joe Mineral Corp. USA (Weakly, L. A.) 1978. (High pressure rock drilling, oil well drilling over 5,000 m., geothermal drilling, penetration rates, rock stresses).

8. Wolstad, O. M. Noecher, R. W., "Development of High Pressure Pumps and Associated Equipment for Fluid Jet Cutting", McCartney Manufacturing Co., Inc.

9. Cummins & Givens, SME Mining Engineering Handbook, Vol, I., 1973 (Section 11.0, drilling data and standard practices).

10. J. C. Bressee, Sc.D., J. D., G. A. Cristy, M. S., W. C. McClain PhD, "Some Comparisons of Continuous and Pulsed Jets for Excavation," Oak Ridge National Lab., USA, 1972. (Specific energy of continuous jet for different rocks and slurry concentrations).

11. B. Grossland, M.Sc., PhD., D.Sc., F. I. Mech-.Eng., F. I. Prod. Eng., J. G. Logan, B.Sc.,PhD.m, "Development ot Equipment for Jet Cutting," Dept. of Mech. Eng., The Queen's Univ. of Belfast (Dr. Crossland), Coleraine Instrument Co., N. Ireland 9dr.Logan), 1972. (high pressure conical joints).

12. H. D. Harris, PhD., W. H. Brierly, "Application of Water Jet Cutting", National Research Council of Canada, DV. of Mech. Eng., Canada. (comparative costs of 3 arrays for kerf-cutting, nozzle size, materials).

13. S. C. Crow, P. V. Lade and G. H. Hurlburt, "The Mechanics of Hydraulic Rock Cutting", Univ. of Calif., USA, 1974. (stand-off dist., pressure, rock permeability and porosity).

14. H. Hamada, T. Fukuda, A. Sijoh, "Basic Study of Concrete Cutting by High Pressure Continuous Water Jets", Kobe Steel Co., Ltd., Japan, 1974. (specific energy, nozzle size, pressure, comprehensive strength).

A substantial number of patents have issued for various hydrojet applications, including:

U.S. Pat. No. 3,138,213
U.S. Pat. No. 3,141,512
U.S. Pat. No. 3,285,349
U.S. Pat. No. 3,396,806
U.S. Pat. No. 3,677,354
U.S. Pat. No. 3,424,256
U.S. Pat. No. 3,554,301
U.S. Pat. No. 3,650,338
U.S. Pat. No. 3,834,787
U.S. Pat. No. 3,567,222
U.S. Pat. No. 3,853,186
U.S. Pat. No. 3,857,449
U.S. Pat. No. 3,888,319
U.S. Pat. No. 3,908,045
U.S. Pat. No. 4,241,796

In spite of all this laboratory and applied research, and in spite of all of the patents which have already been issued, and in spite of what appeared to be tremendous theoretical advantages over prior art drills, hydrojet cutters have not yet had substantial impact. It would probably not be unfair to state that the prior art does not disclose any practical hydrojet rock cutter.

The reason for this apparent contradiction lies in the practical differences between operating a hydrojet cutter by skilled scientists and specialists under laboratory conditions and operating a similar hydrojet cutter in the field by oil drillers or persons of like skill and experience. Reliability which is sufficient in the laboratory is not sufficient in the field. Complications which are not too great in the laboratory are too great in the field. While it is possible to design, build, and operate under laboratory conditions a hydrojet cutter using pressures in excess of 50,000 psi, it is an entirely different matter in the field under field conditions. Hydrojet cutters will probably not be practical for many uses in the field until either technology improves so that the present highest technology laboratory run hydrojet cutters can have designed and built into them those characteristics necessary for operation in the field, or, the opposite situation, until some method can be found to permit hydrojet cutters which can be designed for use in the field to have the efficiency now found only in the more complex not yet practical for use in the field hydrojet cutters.

The present invention attempts to solve this not previously solved problem by giving a hydrojet cutter operating at 10,000 psi very nearly the cutting characterics of substantially more powerful hydrojet cutters by controlling the movement of a 10,000 psi hydrojet cutter in patterns such that shearing of material permits a 10,000 psi hydrojet cutter to do commercially substantially the same amount of work which with prior art designs, depending on the strata, might require as much as 50,000 psi. The use of the shear technique gives much the same advantage which is obtained by a skilled log chopper who knows the proper angle to chip pieces off the log in order to chop through a tree or log in a shorter time with less energy. The use of only a 10,000 psi hydrojet, of course, reduces the size of certain associated equipment and substantially reduces maintenance and wear problems thereby making what was previously not commercially reliable now commercially acceptable and reliable. The present system works because it attacks the rock or other material at its tensile strength, which is the weakest strength of most strata, rather than its compressive strength which is the strongest strength of most strata.

SUMMARY OF THE INVENTION

A hydrojet drilling method and means are presented. The means comprises a base, at least one drilling head and in a preferred embodiment exactly one drilling head, and drilling head coupling means coupling the drilling head to the base. Stabilizing means are coupled to the drilling head to stabilize the drilling head. A variety of control means are coupled to the drilling head to control the drilling head and are coupled to the stabilizing means to control the stabilizing means. A source of cutting fluid is coupled to the drilling head to furnish cutting fluid to the drilling head.

The drilling head comprises a down hole fluid pressure intensification means providing a fluid input and a fluid output. Fluid is provided by a source of cutting fluid such as a settling pond coupled to the pressure intensification means. A strong plenum defining structure having interior surfaces defining a high pressure plenum and having an input and at least three outputs is utilized in a first example to smooth variations in fluid pressure. The input of the high pressure plenum is coupled to the output of the pressure intensification means in a substantially fluid type coupling to receive high pressure fluid from the pressure intensification means. The interior surface of the plenum defined structure defining a generally axially symmetric plenum rotating about an axis. The output of the plenum comprises at least three orifices, exactly three in the first example, disposed generally symmetrically about the axis of the plenum and equal angles about the axis. The orifices comprise flow lines each curved and substantially the same relative orientation about the axis except for displacement about the axis at substantially equal angles from the adjacent flow line. The orifices exit at a downward acute angle of approximately 25 degrees in a first example from a plane perpendicular to the axis of the plenum. The structure defining the plenum is generally axially symmetric and forms an exterior generally axially symmetric plenum structure bearing.

Non-rotating housing means having an interior surface defining a female bearing structure which rotatably mates in a substantially frictionless coupling with an axially symmetric rotating internal retainer bearing. Rotational velocity controlling means are rotatably coupled to the rotating internal retainer affixed to the plenum containing structure to permit selected variation of rotational velocity of the plenum containing structure.

Guard stand-off means are disposed around the exterior surface of the portion of the plenum containing structure defining the orifices and extend in a circle below the lowest point on the plenum containing structure but above a cone defined by rotation of an extension of each orifice. The cone defines the surface through which water or other fluid is pumped from each orifice during rotation of the plenum containing structure. The drill head is moved by drill head moving means capable of selectively moving the drill head in relation to the base in a selected manner in each dimension. Hole casing means and means to emplace the hole casing means so as to reinforce the hole where necessary are provided. Mucking means are provided to muck the cuttings from the hole together with surplus fluid at approximately the same rate that cuttings are cut by the drilling means and that fluid is caused to flow into the hole.

Power means are coupled to the source of cutting fluid which is the settling pond, the stabilizing means, the control means, the drill head coupling means, the mucking means, the means to implace the hole casing means, the pressure intensification means, a plenum containing structure, and the drill head moving means as well as other components of the system to furnish power thereto.

In one example, the stabilizing means comprises a dynamic stabilizer assembly which programs, integrates, and activates a plurality of separate control means for feeding and correcting the location of the drilling head. Logic is done by prior art computer circuitry or electronic circuitry. The control means comprise means for sequential horizontal feed and vertical/angular alignment adjustment thereby directly controlling the drilling head position according to correction signals. The control means cause the drilling head axis to move in a general daisy pattern which pattern is the pattern the center of the drill would make if superimposed on a plane perpendicular to the axis of the drill head. The pattern can be altered by the control regulating the speed of sequencing of movement of the drill head.

The control means provides feeding and alignment adjustment in one example by employing inflators. The inflators receive programmed and metered pressurized fluid as a function of photocell signals causing the inflators to react with the walls defining a drilled hole. The inflators may be repeatedly inflated or deflated and are fabricated from a relatively tough, smooth, flexible fluid tight material such as a neoprene impregnated nylon scrim or mesh or similar material.

An alternate way to control the drill head utilizes an interior surface of the drill means defining orifices coupled to the fluid from the settling pond or source of cutting fluid or some other source. Control of the amount of fluid flowing out the various orifices controls the orientation and spin rate of the drill head.

An interior surface of the drilling means defines orifices coupled to the fluid from a source of cutting fluid pressurized by intensification means and controlling both cutter head rotation and fluid flow velocity such that hydraulic jet impulses are defined by fluid flowing through the orifices of the cutter head and provide cut and clear jet penetration and shear from a plurality of alternated directions of exposed rock or other strata. Coal may be cut by the present invention and generally requires about 20 percent of the pressure required for rock. Accordingly, the same invention utilizing a pressure of 2,000 psi would be sufficient to cut through coal. This has an added advantage in that if the pressure is limited to 2,000 psi, coal can be cut and washed to the surface by the mucking means while rock which resists the 2,000 psi cutting pressure in most cases remains below as do other materials similar to the roof and floor rock.

Control may be obtained by utilizing a plurality of control columnar light sources which may be lasers which are coupled to the base and projected in a selected single direction parallel to each other. Each columnar light source generates a light source parallel to that of each other columnar source and shines on a coupled one of a plurality of matching photocell arrays, one for each columnar light source. The photocell arrays are coupled to the means of reaction control of the drilling head a sufficient distance above the lowest point on the drilling head to remain above the waterline in relatively close proximity to the stabilizer. The control means utilizes the columnar light sources and the plurality of matching photocell arrays to control orientation of the drilling head without cumulative errors and independent of the walls defining any hole drilled by the drilling head.

The control means includes repositioning and relocation circuitry known to the prior art which permits programmed sequencing and the control means to reposition the drill head with corrections during drilling pursuant to instructions from the control means. The photocell arrays that are matched and coupled to the columnar light sources generate signals as a function of where the light is received on the photocell array from the coupled columnar light source by specific inline photocells of each array. The signals from photocells are fed to the control means which utilize the signals to meter fluid reaction forces for the programed orientation and position of the drill head.

Fluid is pumped from the settling pond at pressures of 200–500 psi (pounds per square inch) to the stabilizer means of control in an example using jets for control, and the fluid is released from the control orifices to contribute to the mucking function.

A variety of cutting motions of the drilling head are possible, including causing the control means to move the drilling head in a generally circular pendulum arc during shearing of selected material, an elliptical pendulum arc, a generally linear pendulum-like arc, which linear arc may or may not rotate, and other possible arcs. In operation, it is possible to preprogram certain selected arcs into the control system and, when the cutting rate slows down, to switch to a different series of cutting arcs to adjust to field conditions to cut most efficiently. The control system may comprise any of a substantial number of presently available computers with associated circuitry.

The mucking means comprises a variety of lift pipes known to the prior art consisting of water pipes combined with air injection tubes which remove fluid and cutting material from the bottom of the volume cut by the drill head. A portion of the fluid is derived from the fluid passing through the drill head which enhances the mucking process. The rate of vertical and horizontal movement of the drill head is a function of the mucking rate of the lift pipes. Other sources of fluid are or may be jets used to orient the drill head and pure make-up from the settling pond and fluid which flows into the hole from the strata being drilled.

The bottom of the drilling head comprises a hardened take-up nut which nut retains the rotating plenum defining structure protects the rotating structure from impact and establishes a fixed stand-off distance for cohesive stream formation of the jets of fluid forced through the orifices of the rotating plenum defining structure of the drill head and which nut is capable of adjusting the rotational speed of the plenum defining structure of the drill head. Labyrinth seals seal at least certain of the rotating cylindrical bearing surfaces of the plenum defining structure of the drill head in a low leakage seal. The labyrinth seals in one example seal at least certain flat bearing surfaces of the inner retainer surface of the drilling head and a self-sealing seal. Matching conical bearing surfaces of the inner retainer may provide radial and axial constraint of the rotating plenum defining structure of the drill head. Matching conical bearing surfaces of the inner retainer may absorb and translate externally applied shock loads through the bearing surfaces of the mounting base of the drilling head.

For certain applications, the drilling means may comprise a plurality of drill heads, each drill head including a separate rotating high pressure plenum retaining structure. The drilling means may comprise a plurality of rotating plenum retaining structures each within its drill head, each drill head utilizing a common high pressure plenum in an alternate to the example described in the preceding sentence.

In one embodiment, the means of pressure intensification provided for the drill means comprises a closed loop hydraulic system capable of providing and sustaining pressures of about 10,000 psi to the cutting fluid. The means of pressure intensification provided for the drilling means may comprise open loop stacked gear pumps serially boosting input cutting fluid supplied at low pressure such as 250–500 psi to an output plenum pressure of about 10,000 psi.

A means of pressure intensification using one or more double acting intensifiers comprises modified end caps or retaining structures shaped as a triangle to reduce the intensifier closed loop hydraulic system configuration circumferential size. The open loop "stacked" series gear pump output pressure may be augmented by pulsation reducing and damping means.

Continuous wall casing means comprising a plurality of radially and axially moveable segments capable of retaining the injection material or rapidly curing chemical and shotcrete wall reinforcement material may be utilized. The advancement of the wall casing means may intrude into the volume of mucking fluid just below the waterline formed by water at the bottom of the hole being used for mucking.

The control means may provide feeding and alignment adjustment by employing reaction jets which receive programed and metered pressurized fluid as a function of photocell signals. The jet total impulse and fluid mass are capable of reacting with the mucking fluid and the wall defining a drilled hole.

The control means provides feeding and alignment adjustment by employing pistons, in another example, which pistons receive programed and metered pressurized fluid or other power as a function of photocell signals. The pistons exert force on the walls defining the drilled hole to control drilling head orientation.

Fluid may be pumped from a surface fluid settling pond as make-up for performing the mucking function, which fluid would then be supplied directly proportional to the rate of mucking, but limited to a level in the hole just below the photocell receiver arrays.

A plurality of controlled columnar light sources may comprise leveling means adjustable for fixed horizontal positioning of the light sources in the drilled hole. The plurality of controlled columnar light sources may comprise a leveling means adjustable for a pre-determined non-horizontal positioning of the sources in the drilled hole. A plurality of controlled columnar light sources may comprise lowering means of the light sources to a lower hole elevation while maintaining one only of the fixed horizontal positions of the light sources and the fixed non-horizontal positioning of the light sources in the drilled hole.

It should be noted that an invention as claimed herein includes the capability of using the lift pipes and air injection tubes as a collection and diversion means of removing pressurized fluid from the hole when such fluids are reached at producing strata and aquifers. In practical terms, this means that if you discover oil, you can suck it right up because oil and gas are lighter than the water in the hole and are pressurized. Obviously some means should be utilized to determine what is coming up the lift pipes if the oil and gas are not highly pressurized. A relief valve at the pumps which cause the lift pipes to suck up fluid will divert the oil or gas to storage.

DRAWING DESCRIPTION

Reference should be made at this time to the following detailed description which should be read in conjunction with the following drawings, of which:

FIG. 3 illustrates a daisy pattern cutting of the drilling head of FIG. 2 when the drilling head is swung in a linear pendulum-like arc and the line is rotated about 36 degrees with each swing of the drilling head;

FIG. 3A illustrates a more detailed drawing of an example of drilling means according to the present invention, which drilling means use jets of water for control and stabilizing purposes;

FIG. 3B illustrates a drilling head according to the present invention swinging in a typical drilling pattern;

FIG. 4 illustrates the end of the drilling head and shows the orifices through which cutting fluid exits the drilling head;

FIG. 5 is a cutaway side view of a drilling head according to the present invention;

Figure 11:
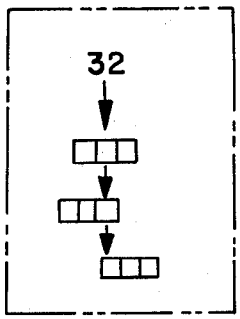

FIG. 11 illustrates how three part photocell receptors may be utilized to generate a control signal based on movement of the drilling head away from a central point and correction of the drilling head in response to movements off center; and FIG. 3C top portion indicates the cutting pattern of an individual one of the three or more orifice fluid flows after leaving the orifice and the bottom portion illustrates a side view of the cutting pattern of the fluid flowing from a single orifice as the drill head swings back and forth.

DETAILED DESCRIPTION

Figure 1:
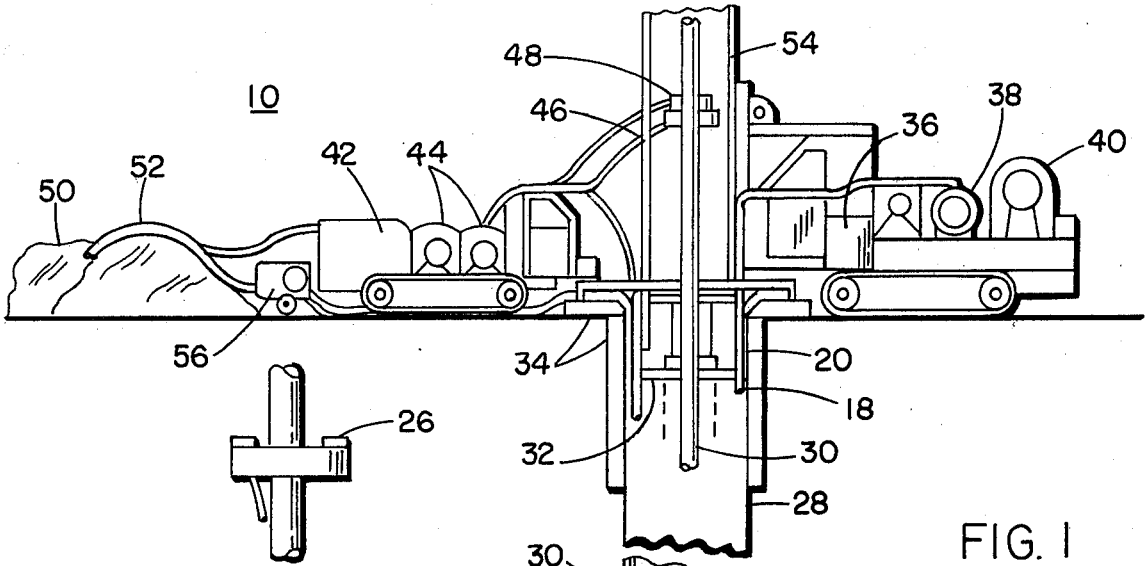
FIG. 1 is a side view of an example of drilling means according to the present invention.

Reference should be made at this time of FIG. 1 which illustrates a side view of drilling means 10 according to the present invention. The drilling means 10 includes a drilling head 12 also known as a cutting head 12, a dynamic stabilizer assembly 14, a pressure intensifier 16 also known as a pump 16, a plurality of air hoses 18 and lift pipes 20. The drilling head 12 cuts a hole which is filled with mucking water 22 below a waterline 195. Light reference receiver means 26 are slightly above the waterline 195. A wall casing 28 may be utilized to firm the sides of the hole excavated by the cutting head 12. Drilling head coupling means 30 also known as a stringer 30 couple the drilling head to a base 54 or rig 54 which is approximately at the surface of the ground or slightly above the surface of the ground. A plurality of light sources 32 each transmit parallel columnar light rays to an associated light reference receiver 26 slightly above the waterline 195 to generate a signal which is utilized by control means coupled to the drilling head 12 to control the drilling head. The control means generate control signals which enable stabilizing means coupled to the drilling head 12 to stabilize the drilling head 12. In FIG. 1 the controls are shown as 36 in the trailer on the surface, but of course, the controls 36 could be any convenient place. A sleeve and collar arrangement 34 reinforces the top of the hole. The surface equipment on the trailers also includes a compressor 38 powered by a generator 40. In this first example, water piped from a settling pond 50 over a dike 52 to the rig 54 by water supply line 46 is utilized. Mucking removes the mucking water 22. The mucking water 22 is pumped by surface pumps 44 through a separator 42 back to the settling pond 50. Additive 48 is added to the water before the water is used for cutting by the drilling head 12. Dirty water 22 from the hole is sent through a sump pump and separator 56 which removes the heaviest particles from the water and pumps the slightly cleaned water to the settling pond 50. Most of the remaining particles settle out in the settling pond 50. Water is then removed from the settling pond 50 and sent through a separator 42 which separates out all particles in excess of 5 microns. The surface pumps 44 which have lifted the water out of the settling pond 50 then pump it through waterlines 46 to the rig 54 where additive 48 is added to the water. Accordingly, the mucking water 22 which is dirty flows up through the lift pipes and is cleaned then returned to the drilling head 12 for reuse.

Figure 2:
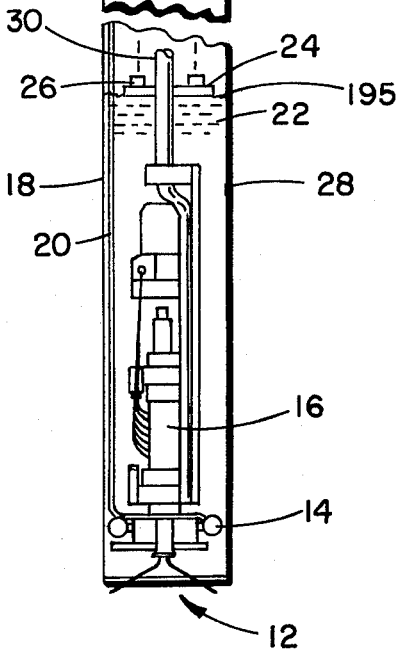
FIG. 2 illustrates the lower portion of the drilling means of FIG. 1 in somewhat different and greater detail.
Figure 2:
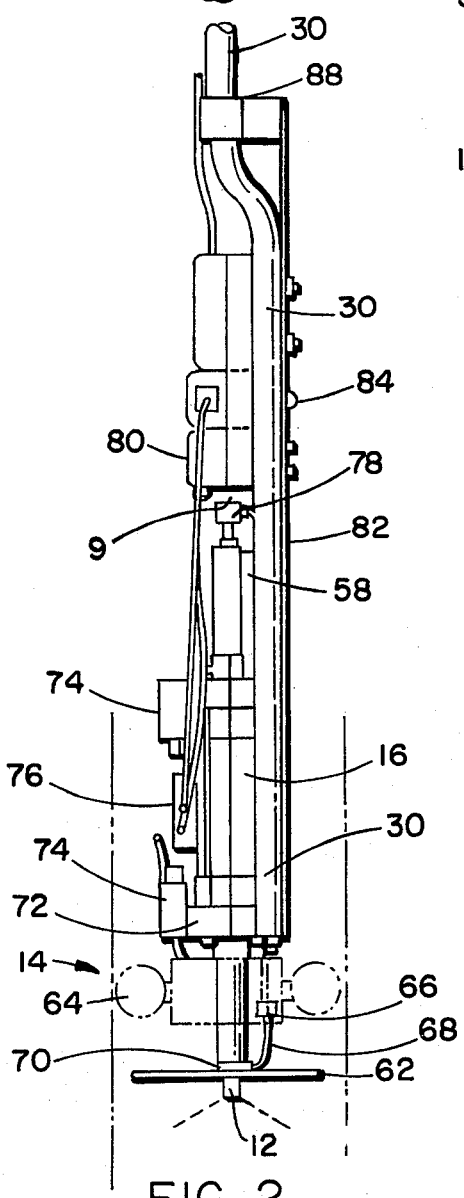
Figure 2A:
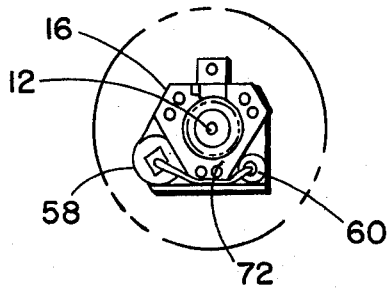
FIG. 2A illustrates the bottom view of the drilling head of the drilling means of FIG. 2.

Reference should be made at this time to FIG. 2 and FIG. 2A which show a slightly different view of the drilling head 12 and associated circuitry in slightly greater detail. The drilling head 12 includes a down hole fluid pressure intensification means 16 which may be a pump 16 which receives fluid from the waterline 46 shown in FIG. 1. Other fluids than water may be utilized but for most purposes, water is sufficient. A strong plenum defining structure has interior surfaces defining a high pressure plenum 70 which has an input and at least three outputs. The input of the high pressure plenum 70 comprises a water feedline 68 coupled to the output of the pressure intensification means 16 in a substantially fluid tight coupling to receive high pressure fluid from the pressure intensification means 16. The interior surface of the plenum 70 defines a generally axially symmetric plenum in this example, which rotates about an axis. The output of the plenum 70 comprises in this example, three orifices 112 (shown in FIG. 4) disposed generally symmetrically about the axis of the plenum 70 at equal angles about the axis. The orifices 112 comprise flow lines each curved in substantially the same relative orientation about the axis except for displacement about the axis at substantially equal angles from the adjacent flow lines. A portion of the outer surface of said orifices 112 exits at a downward acute angle from a plane perpendicular to the axis as best shown in FIG. 5. The structure defining the plenum 70 is axially symmetric in this example and forms an exterior axially symmetric plenum structure bearing.

Equivalents of the present invention having a nonaxially symmetric plenum 70 may be designed, but they would not be dynamically balanced.

Other items illustrated in FIG. 2 include a retainer block 72, which holds the assembly of other parts together, limit switch control valves 74 which control fluid flow, control valve 76 which control fluid flow, the stringer 30 which includes the water feedline and the means of suspension, and the pump 16.

FIG. 2 illustrates a double acting pressure intensifier by means of which pressure is stepped up to the desired pressure of approximately 10,000 psi and sustained at 10,000 psi. The accumulator 58 steps up the pressure of the fluid which is then fed to the plenum 70 for stabilizing flow out the orifices 112. The devices described herein are held together by means known to the prior art such as plates 82 and couplers 84. The weldment is a type of holding bracket which supports and retains the stringer 30.

Reference should now be made to FIG. 2A which represents a cutaway section of a portion of FIG. 2 showing the relative positions of the cutting head 12 in the center, the pump 16 and the accumulator 58. Double acting pressure intensifiers are known to the prior art and need not be explained here in detail. Their purpose is to cause the pressure of water being pumped out of the orifices to remain relatively constant. In the absence of such a device, the water pressure would increase and decrease as a function of where the pump was in its cycle.

The cutting fluid supply manifold 60 contains water pumped from the surface at a pressure of approximately 250 psi-500 psi. Said water is then acted upon by the combination of the accumulator 58 and pump 16 and is squirted out at approximately the speed of sound in air at sea level through the orifices 112 at approximately 10,000 psi. Accordingly, the water to the orifices 112 comes from a high pressure plenum 70 which contains water retained at a high pressure and constantly replenished by means of the pump 16. Accordingly, the plenum 70 has a tendency to smooth out variations in the pressure of the water squirted out the orifices 112. In the first example of the invention described herein the pressure intensification means 16 utilizes a closed loop system which provides internal fluid to the double acting intensifier which in turn boosts the cutting fluid pressure being supplied through the stringer 30. Other means are known to the prior art which could also be used to intensify the pressure of the water or other fluid being pumped out or squirted out the orifices 112. Among these are slave pumps also known as stacked positive displacement gear pumps.

FIG. 5 further discloses nonrotating housing means 120 having an interior surface defining a female bearing structure 136 which in turn has a bearing surface 138 rotatably mating in a substantially frictionless coupling with the axially symmetric exterior bearing surface of the housing 120.

FIG. 5 also discloses rotational velocity controlling means, the surface between the housing 120 and plenum body 124. The housing 120 is rotatably coupled to the rotating internal retainer 136 also known as a bearing 136 affixed to the plenum containing structure 116 also referred to as a jet structure 116 which has an interior surface defining a plenum 126. The combination permits selective variation of rotational velocity of the plenum containing structure 116 by a mere tightening or loosening of the housing 120. Tightening the housing 120 will increase the friction thereby reducing the rotational velocity of the structure defining the exit orifices 112. A retaining nut 122 locks the housing 120 in place. An axis hole 118 is utilized during assembly and disassembly of the drilling head 12. Proper orientation of the axis nut 118 and proper rotation of a hex socket 114 with the bearing 136 permits easy assembly and disassembly of the drilling head 12 as shown in greater detail in FIG. 5. You place a socket wrench in the hex socket 114 and holding of the structure surrounding the axis hole 118 with a pin permits easy rotation of the jet structure 116 for assembly or disassembly. Bearing plated ceramic 128 is a plating put on the ceramic for truing up and lap fit. Labyrinth seals 130 prevent leakage between the plenum body 124 and the jet structure 116. Other moving surfaces are also sealed by means known to the prior art to prevent leakage. The bottom of the housing 120 surrounds the orifices 112 and provides guard stand-off means which are disposed around the exterior surface of the portion of the plenum containing structure 116 defining the orifices 112 and extending in a circle below the lowest point on the plenum containing structure 116 but above a cone defined by rotation of an extension of each orifice 112. (That cone defines where the water flows during rotation of the orifices 112.)

Reference should be made at this time to FIGS. 3, 3A, and 3B which illustrate movement of the drilling head 12. FIG. 3A illustrates one technique used to stabilize and control the drilling head 12 by the use of reaction jets 100A, B, C, D and E. Proper control of fluid flow out through the reaction jets 100 permits the drilling head to be moved in any pattern in a pendulum like arc. What is thought to be the best pattern for most types of cutting is shown in FIG. 3 and is referred to as a daisy pattern which pattern is altered by the control means by means of the reaction jets 100 or equivalent control means regulating the speed of sequencing of movement of the drilling head 12 during a generally linear pendulum like arc. The reaction jets 100 may be oriented as shown in FIG. 3A where they are offset at an angle from a radius taken from the axis of the stringer 30 so that they cause rotation of the drilling head 12 as well as orientation. Alternatively, the reaction jets may be oriented along radii from the axis and in such case would not cause rotation of the drilling head 12 but would only change its orientation. FIG. 3B illustrates a cutting pattern 110 formed by pendulum like swings of the same drilling head 12 which is shown in two different positions on FIG. 3B. It should be noted that under the pressures used in the present system, and with orifices 110 of a diameter of 0.032 inches, in a first example of the invention, the drilling head 12 will swing back and forth in a daisy pattern or oscillation pattern having a diameter of approximately 8 inches. The pattern would not be exactly as shown in FIG. 3 because the drilling head 12 is continually lowered, but FIG. 3 illustrates a superimposition of the daisy pattern on a planar surface. While the daisy pattern would be approximately 8 inches in diameter, the jets of water from the orifices 112 would cut approximately another 8 inches in each direction giving a total hole diameter of approximately 24 inches from a drilling head approximately one inch in diameter or less in size. Even larger holes can be drilled simply by increasing the oscillation diameter of the daisy pattern 110 or by increasing the water pressure or by drilling in nonconsolidated strata. It is quite easy to drill a 24 inch diameter hole with a three quarter inch diameter drilling head through the hardest rock known. Of course, very, very hard or very, very tough materials slow down the drilling process as do highly compressed materials. But for medium hard rock which is the standard in the industry, a drill such as disclosed herein cuts at three times the rate of prior art conventional mechanical drills.

Figure 9:
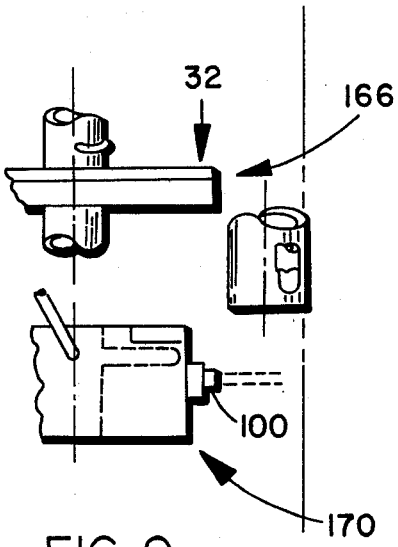
FIG. 9 illustrates a side view of a reaction jet stabilizer which may be used to control and stabilize the drilling head in place of and instead of the inflators of FIG. 8 and further illustrates a side view of photocells used to receive control signals for the control and stabilizing of a drilling head.
Figure 7:
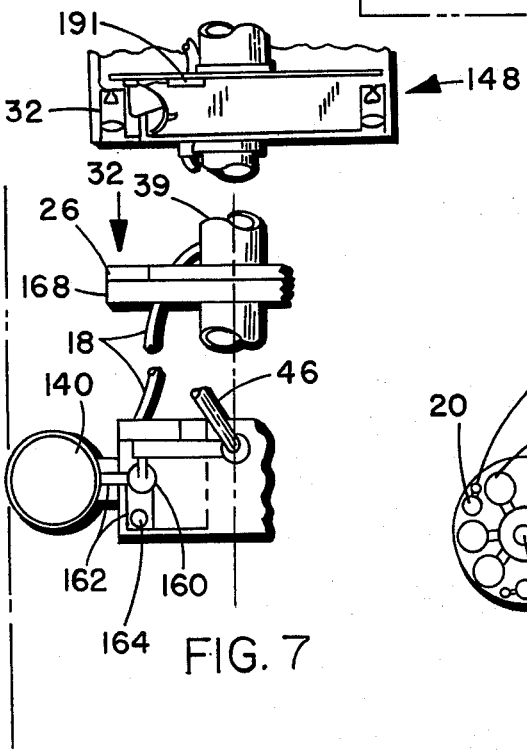
FIG. 7 illustrates one of the inflators of FIG. 6 together with appropriate control circuitry.
Figure 8:
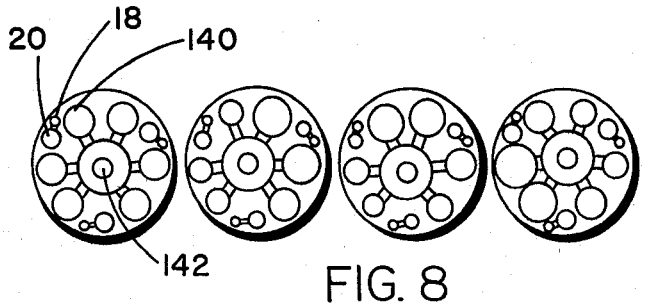
FIG. 8 is a timed sequence drawing illustrating the use of inflators to control and stabilize a drilling head.

Reference should be made at this time to FIGS. 7, 8 and 9 which illustrate selected parts of a control means which provides alignment adjustment by employing inflators 140 that are capable of reacting with walls 144 defining a drilled hole. Such a control means utilizing inflators 140 can include repositioning and relocation circuitry which permits the control means to reposition the drill head 12 and relocate the drill head 12 also referred to as drilling head 12 during drilling pursuant to instructions from the control means.

Figure 6:
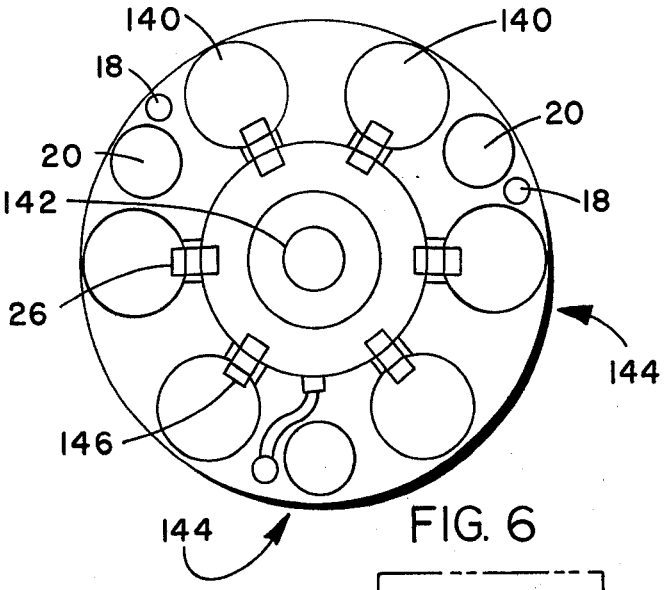
FIG. 6 illustrates an example of the invention in which inflators are used to control and stabilize a drilling head and further illustrates lift pipes used for mucking.

The inflators 140 are inflated or deflated pursuant to instructions received from the controls 36 which may also be referred to as the control means 36. FIG. 6 also illustrates in cross-section form air hoses 18 and lift pipes 20. The air hoses transmit air down hole for mucking purposes and the lift pipes transmit fluid carrying cuttings back up hole. Inflation of a particular inflator 140 causes the inflator to push against the side 144 of the hole thereby pushing the stringer 130 farther away from that side of the hole. Precise movement of the stringer and drill head 12 on a pendulum-like arc can be achieved by proper inflation and deflation of selected inflators 140. The inflators 140 slide down the side of the hole as the drill 12 cuts deeper into the earth and is lowered for additional cutting.

FIG. 7 gives a partially cutaway side view of an inflator 140 and associated circuitry. The light source 32 is at a selected point substantially above the inflators, sometimes more than a quarter mile above the inflators. The air hose 18 and lift pipes 20 extend substantially the length of the hole except for the very bottom portion of the hole. The water supply line 46 brings water or other cutting fluid from the settling pond 50 down to the drill head 12 via circuitry described elsewhere. The necessary adjustments are controlled with the assistance of a solenoid valve 160, a switch 162, and a rotary switch 164 and associated circuitry shown in FIGS. 9, 10 and 11.

FIG. 8 illustrates how the stringer hole 142 which is disposed around the stringer can be moved to move the drill head 12 which is suspended under the stringer. Four different possible adjustments are shown in FIG. 8. Inflation of inflators 140 on one side of the stringer hole 142 forces the stringer hole to move toward the opposite side. Deflation of the inflators can permit the stringer hole to move in a pendulum-like arc controlled by periodic inflation of that combination of inflators which is necessary to force the stringer hole 142 to swing in the required direction. For most precise control, it would be possible to keep all inflators at least partially inflated so that all inflators or nearly all inflators are exerting pressure against the hole wall 144 and the swinger hole 142 is moved in response to the force exerted by the wall upon the associated inflators 140. The inflators 140 comprise tough, relatively smooth skinned spherical when inflated containers capable of being repeatedly inflated and deflated. Inflation is from air carried down into the hole through the air hoses and deflation releases air into the hole which flows upward and out of the top of the hole.

Reference should now be made to FIGS. 6, 7 and 11 which perhaps best illustrate the use of a columnar light source to align and control the drill head 12. The light signals are used to generate signals which control the metering of pressurized fluid which is in the case of inflators 140 is air which is used to inflate inflators or is removed from inflators 140 or if, as shown in FIG. 3A, jets are used, the fluid controlled would be water which would be pumped out of the jets 100 in a selected manner. Other means known to the prior art such as pistons (not shown) could also be used to control the orientation of a drilling head 12. Pistons would also be controlled by pressurized fluid in many cases but could also be controlled by other means such as electrical motors.

For different purposes there will be a different number of inflators 140 or jets 100 or other means used to control the orientation of the drill head 12. Six inflators 140 are shown on FIG. 6 and five jets 100 are shown on FIG. 3A, but other numbers of either may also be used. Each control device whether jet 100, inflator 140, or other means would have its own associated columnar light source 32 and light reference receiver 26. Each light reference receiver 26 would have at least three different light reference receivers or photocells as best shown in FIG. 11. If that particular light reference receiver 26 was correctly oriented as shown in the top of the three illustrations in FIG. 11, the light would be received in the central portion of the light reference receiver 26 and no correction signal would be generated so that the pressurized flow whether of a fluid or an electricity would be maintained at the pre-existing level. If the light reference receiver and its associated structure were moved in one direction as shown in the center of the three examples in FIG. 11, a signal directing a correction in the opposite direction would be generated. In like manner, if the light reference receiver 26 were moved in the opposite direction as shown in the bottom of the three illustrations in FIG. 11, an opposite correcting signal would be generated.

Figure 10:
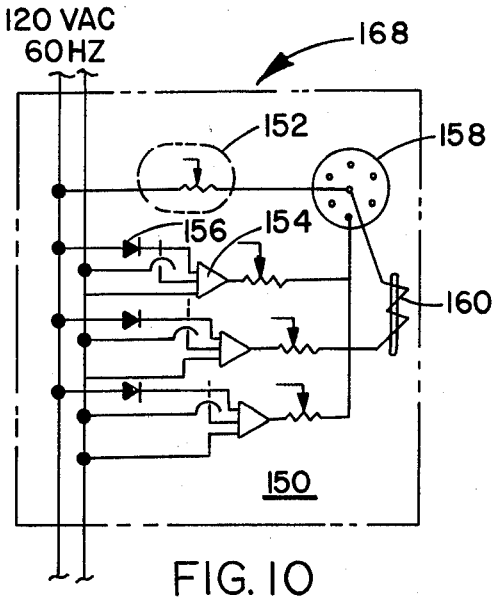
FIG. 10 is a partial schematic diagram of a photocell-/valve circuit used to control a drilling head according to the present invention.

The photocell arrays, also known as light reference receivers 26 that are matched and coupled to the columnar light sources 32 generate signals as a function of where the light is received on the photocell array 26 from the coupled columnar light source 32 by specific in-line photocells of each array 26 as best shown on FIG. 11. If the light is received in the center of the array 26 as shown at the top of FIG. 11, no change of signal is generated. If light is received at either the right side of the array as shown in the middle of FIG. 11 or the left side of the array as shown at the bottom of FIG. 11, a compensating correction signal is generated. The circuitry utilized to perform this task is shown in large part in FIG. 10. Parts not shown are well known to the prior art. FIG. 10 illustrates three amplifiers 154 coupled through adjustable resisters to a fixed position switch 158 and a solenoid valve 160. Each of the three amplifiers 154 corresponds to a separate photocell of the light reference receiver 26 of FIG. 11. The central amplifier 154 generates a current when the top condition in FIG. 11 occurs and meter the solenoid valve 160 so that there is no change in the operating condition. The top and bottom amplifiers generate currents when corrections are required which meter and control a greater or less signal to the solenoid 160 which causes the solenoid 160 to generate appropriate control signals. The six position switch 158 is utilized for selection purposes. Obviously, different size switches and different circuit arrangements could be utilized to perform the same functions described herein. The variable resistor 152 and the diodes 156 are used to control voltage levels.

Continuous wall casing means may be utilized with the drilling means under appropriate conditions. The wall casing means comprise a plurality of radially and axially moveable segments (not shown) capable of retaining the injection material of rapidly curing chemical and shotcrete wall reinforcement material. This permits casing to be applied continuously. This is particularly valuable when the hole is very long or changes directions a substantial number of times or varies in size. This reduces the number of cycles of stoppage. Other concepts in the present invention when applied as set forth herein also substantially reduce the number of stops and starts necessary while drilling a hole thereby speeding drilling. A plurality of controlled columnar light sources 32 can be utilized with the present invention. This application comprises lowering means of the light sources 32 to a lower level elevation or a level farther into the hole if you are not drilling down while maintaining one only of the fixed horizontal positioning of the light sources 32 and the fixed non-horizontal positioning of the light sources 32 in the drilled hole defined by the base 54 or rig 54.

The drill head 12 includes a rotating plenum structure means (not shown) in another example, of a cast material of hardness and density capable of resisting material erosion by cutting fluid flow through the structure.

The lift pipes 20 and air hoses 18 also referred to as air injection tubes 18 can be used as a collection and diversion means for pressurized fluids when such fluids are reached at producing strata and aquifers. The diversion means comprises a relief valve (not shown) at the pumps which normally assist in mucking which relief valve is energized when the pumps stall because of over-pressurized fluid received through the lift pipes. The relief valves then divert the over-pressurized fluid to storage.

The present invention also permits use of the method of drilling a hole about a selected line utilizing cutting fluid in a means not known to the prior art. As described in the structure here, this method comprises increasing the pressure of fluid to thousands of psi by means of a pressure intensifier. In the case of coal, a pressure of 2,000 psi would be suitable, and would permit cutting out the coal without cutting out the strata comprising the roof and floor. In the case of more typical strata which must be drilled through, 10,000 psi would be a suitable pressure for nearly all strata.

It is necessary to cause the fluid to flow through at least three narrow orifices 112 defined by the interior surfaces of a hydrojet drill head 12. The three orifices need to be disposed at equal angles about an axis of the drill head 12. Each orifice 112 would have a diameter of less than 0.050 inches, 0.032 inches having been found suitable for most strata. Each orifice would exit the drill head at an angle of approximately 25 degrees below a plane perpendicular to the vertical or 25 degrees below a plane perpendicular to the axis of the drill head, or 25 degrees perpendicular to the direction of drilling of the hole. This acute angle of approximately 25 degrees might be anywhere between 20 degrees and 40 degrees for varying applications. The last approximately half of the length of each orifice 112 prior to exiting from the drill head 12 needs to be disposed about an orifice axis to permit vibrationless drilling.

The drill head 12 is then continually lowered at a selected drilling rate to cut back adjacent surfaces defining the hole in the strata. Mucking water is removed out of the hole by lift pipes and the associated mucking means so that cuttings are removed from the hole at approximately the same rate they are cut by the drill head 12. The drill head 12 is rotated so that the fluid emitted from the orifices 112 is continually emitted at a different angle.

The drill head 12 is swung back and forth in a preselected swing which may be very complex so that the orientation of the drill head 12 with respect to the walls of the hole continually changes. In this way the interior surface defining the hole is cut by streams of high pressure fluid coming from a variety of directions and a variety of angles thereby chipping relatively large pieces from the strata by shearing. This takes advantage of the fact that practically all strata are very strong when you attempt to attack them with compression, but are relatively weak when you attempt to attack their tensile strength.

Fluid is pumped from a settling pond 50 at pressures of 250–500 psi (pounds per square inch) to the stabilizer means of control 14 also referred to as the dynamic stabilizer assembly 14 and combines with the fluid released from the control orifices 100 to contribute to the mucking function in systems utilizing control orifices 100 which are also referred to as reaction jets 100. The drill head 12, depending on the strata and the type of hole to be drilled, may be caused to move by the control circuitry 24 and 36 in a generally circular pendulum arc, in a generally elliptical pendulum arc, in a generally linear pendulum-like arc, or in a generally linear pendulum-like arc wherein the line of the pendulum-like arc is rotated at a selected rotational velocity, depending on the conditions of drilling. Mucking fluid 22 also known as mucking water 22 is pumped out by a sump pump 56 which also includes a separator to separate out the larger particle. A portion of the fluid derives from the drill head 12 cutting fluid which is used to enhance the mucking process by causing the water to flow violently because of fluid emitted from the orifices 112. Air from the air hose 18 also enhances the mucking process by causing the particles in the mucking fluid to be suspended in the fluid or water which is pumped out by the sump pump 56. This air is blown into the lift pipes 20 or lift tubes 20 at various stages which are determined as they have been determined in the prior art. The rate of vertical and horizontal movement of the drill head 12 which determines the amount of cutting is, of course, a function of the mucking rate of the lift pipes 20 because it is necessary to remove cuttings from the hole at about the same rate they are cut.

The bottom of the drill head 12 comprises a hardened take-up nut 120 also known as a housing 120 which nut 120 retains the rotating plenum defining structure 116 also referred to as a jet structure 116 from impact and establishes a fixed stand-off distance for cohesive stream formation of the jet of fluid forced through the orifices 112 of the rotating plenum defining structure 116 of the drill head 12. The nut 120 is capable of adjusting the rotational speed of the plenum defining structure of the drill head 12 by merely tightening the nut 120.

Labyrinth seals 130 seal at least certain of the rotating cylindrical bearing surfaces 128 also referred to as bearing plated ceramic 128 of the plenum defining structure 116 of the drill head 12 in a low leakage seal.

The labyrinth seals 130 seal at least certain flat bearing surfaces 134 of an inner retainer surface 136 of the drill head 12 in a self-sealing seal. Matching conical bearing surfaces 138 of the inner retainer 136 provide radial and axial constraint of the rotating of the plenum defining structure 116 of the drill head 12. The matching conical bearing surfaces 138 of the inner retainer 136 absorb and translate the externally applied shock loads to the bearing surfaces 134 of the mounting base 124 of the drill head 12.

The drilling means 10 may comprise a plurality of drill heads 12, each drill head 12 including a separate rotating high pressure plenum retaining structure 116 associated with that drill head. In an alternative example, the drilling means 12 may comprise a plurality of plenum rotating structure (not shown) each within its drill head (not shown), each drill head utilizing a common high pressure plenum (not shown) to which it is coupled.

The means of pressure intensification provided for the drilling means 10 in the present example comprises a closed loop hydraulic system capable of providing and sustaining pressures of in excess of 10,000 psi to the cutting fluid.

The means of pressure intensification used may comprise at least one double acting intensifier which comprise modified end cap retaining structures having a triangular cross-section shape to reduce the intensifier closed loop hydraulic system configuration circumferential size to make the combined package which goes into the hole smaller. The means of pressure intensification provided for the drilling means 10 may also comprise in a different example open loop stacked gear positive displacement pumps (not shown) serially boosting input cutting fluid supplied at low pressures to an output plenum pressure of about 10,000 psi. The open loop stacked series gear pump output pressure may be augmented by pulsation reducing and damping means known to the prior art and not shown.

for certain applications wall casing is necessary. Continuous wall casing means may be utilized which comprise a plurality of radially and axially moveable segments (not shown) capable of retaining the injection material of rapidly curing chemical and shotcrete wall reinforcement material. The advancement of the wall casing means may intrude into the volume of mucking fluid 22 just below the waterline 195.

A particular example of the invention has been described together with alternatives. The term "may" usually has referred to an alternative. The invention, however, is limited only by the following claims.

I claim:

1. Hydrojet drilling means, comprising:

a base;

at least one drill head disposed about an axis;

drill head coupling means coupling the drill head to the base;

stabilizing means coupled to the drill head to stabilize the drill head;

control means coupled to the drill head to control the drill head;

a source of cutting fluid coupled to the drill head to furnish cutting fluid to the drill head;

wherein the drill head comprises:

a down hole fluid pressure intensification means providing a fluid input and a fluid output;

a source of cutting fluid coupled to the pressure intensification means;

a strong plenum defining structure having interior surfaces defining a high pressure plenum having an input and at least three outputs, the input of the high pressure plenum being coupled to the output of the pressure intensification means in a substantially fluid tight coupling to receive high pressure fluid from the pressure intensification means, the interior surface of the plenum defining structure defining a generally axially symmetric plenum rotating about an axis, the output of the plenum comprising at least three orifices disposed generally symmetrically about the axis of the plenum at equal angles about the axis, the orifices comprising flow lines each curved in substantially the same relative orientation about the axis except for displacement about the axis at substantially equal angles from the adjacent flow lines, said orifices exiting at a downward acute angle from a plane perpendicular to the axis, the structure defining the plenum being axially symmetric and forming an exterior axially symmetric plenum structure bearing;

non-rotating housing means having an interior surface defining a female bearing structure rotatably mating in a substantially frictionless coupling with an axially symmetric rotating internal retainer bearing;

rotational velocity controlling means rotatably coupled to the rotating internal retainer affixed to the plenum containing structure to permit selective variation of rotational velocity of the plenum containing structure;

guard stand-off means disposed around the exterior surface of the portion of the plenum containing structure defining the orifices and extending in a circle below the lowest point on the plenum containing structure but above a cone defined by rotation of an extension of each orifice;

drill head moving means capable of selectively moving the drill head in relation to the base in a selected manner in each dimension;

mucking means;

hole casing means and means to emplace the hole casing means in drilled holes requiring hole casing means; and power means coupled to the source of cutting fluid, the stabilizing means, the control means, the drill head coupling means plenum containing structure, and the drill head moving means to furnish power thereto.

2. The invention of claim 1 wherein the stabilizing means comprises a dynamic stabilizer assembly which programs, integrates and activates a plurality of separate control means for feeding and correcting the location of the drill head.

3. The invention of claim 1 wherein the control means comprise means for sequential, horizontal feed and vertical and angular alignment adjustment thereby directly controlling the drill head position according to correction signals, causing the drill head to move in a general daisy pattern superimposed on a plane perpendicular to the drill head axis which pattern is altered by the control means regulating the speed of sequencing of movement of the drill head.

4. The invention of claim 1 wherein the control means provides feeding and alignment adjustment by employing inflators which receive programed and metered pressurized fluid as a function of photocell signals causing the inflators to react with the walls defining a drilled hole.

5. The invention of claim 1 further including an interior surface of the drilling means defining orifices coupled to the fluid from the source of cutting fluid pressurized by intensifier means and controlling both cutter head rotation and fluid flow velocity such that hydraulic jet impulses are defined by fluid flowing through the orifices of the cutter head and provide cut and clear jet penetration and shear of exposed strata from a plurality of alternating directions.

6. The invention of claim 1 further including a plurality of controlled columnar light sources coupled to the base and projected in a selected single direction, each columnar source generating a light source parallel to that of each other columnar source, and shining on a coupled one of a plurality of matching photocell arrays, one for each columnar source, coupled to means of reaction control of the drill head a sufficient distance above the lowest point on the drill head to remain above the waterline in relatively close proximity to the stabilizer, the control means utilizing the columnar light sources and the light received by the plurality of matching photocell arrays from the light sources to control orientation of the drill head without cumulative errors and independent of the walls defining any hole drilled by the drill head.

7. The invention of claim 6 wherein the columnar light sources are lasers.

8. The invention of claim 6 wherein the control means includes repositioning and relocation circuitry which permits programed sequencing and the control means to reposition the drill head with correction during drilling pursuant to instructions from the control means.

9. The invention of claim 8 wherein the photocell arrays that are matched and coupled to the columnar light sources generate signals as a function of where the light is received on the photocell array from the coupled columnar light source by specific in-line photocells of each array, the signals from photocells are fed to the control means which utilize the signals control fluid reaction forces for the programed orientation and position of the drill head.

10. The invention of claim 1 wherein fluid is pumped from a settling pond at pressures of 250–500 psi to the stabilizer means of control and combines with the fluid released from the control orifices to contribute to the mucking function.

11. The invention of claim 1 wherein the drill head is caused to move by the control means in a generally circular pendulum arc during shearing of selected material.

12. The invention of claim 1 wherein the drill head is caused to move by the control means in a generally elliptical pendulum arc during shearing of selected strata.

13. The invention of claim 1 wherein the drill head is caused to move by the control means in a generally linear pendulum-like arc during shearing of selected material.

14. The invention of claim 13 wherein the line of the pendulum-like arc is rotated at a selected rotational velocity.

15. The invention of claim 1 wherein the mucking means comprises a plurality of lift pipes consisting of water pipes combined with air injection tubes which remove fluid and material from the bottom of the volume cut by the drill head, fluid and material being pumped by at least one pump, a portion of which fluid derives from the drill head cutting fluid which is used to enhance the mucking process.

16. The invention of claim 15 wherein the rate of vertical and horizontal movement of the drill head is a function of the mucking rate of the lift pipes.

17. The invention of claim 1 wherein the bottom of the drill head comprises a hardened take-up nut which nut retains the rotating plenum defining structure, protects the rotating plenum defining structure from impact and establishes a fixed stand-off distance for cohesive stream formation of the jets of fluid forced through the orifices of the rotating plenum defining structure of the drill head and which nut is capable of adjusting the rotational speed of the plenum defining structure of the drill head.

18. The invention of claim 1 wherein labyrinth seals seal at least certain of the rotating cylindrical bearing surfaces of the plenum defining structure of the drill head in a low leakage seal.

19. The invention of claim 18 wherein labyrinth seals seal at least certain flat bearing surfaces of an inner retainer surface of the drill head in a self-sealing seal.

20. The invention of claim 19 wherein matching conical bearing surfaces of the inner retainer provide radial and axial constraint of the rotating of the plenum defining structure of the drill head.

21. The invention of claim 20 wherein matching conical bearing surfaces of the inner retainer absorb and translate externally applied shock loads to the bearing surfaces of the mounting base of the drill head.

22. The invention of claim 1 wherein the drilling means comprises a plurality of drill heads, each drill head including a separate rotating high pressure plenum retaining structure associated with that drill head.

23. The invention of claim 1 wherein the drilling means comprises a plurality of rotating plenum retaining structures each within its drill head, each drill head utilizing a common high pressure plenum to which it is coupled.

24. The invention of claim 1 wherein the means of pressure intensification provided for the drilling means comprises a closed loop hydraulic system capable of providing and sustaining pressures of about 10,000 psi to the cutting fluid.

25. The invention of claim 1 wherein the means of pressure intensification used comprises at least one double acting intensifier which comprise modified end cap retaining structures having a triangular cross-section shape to reduce the intensifier closed loop hydraulic system configuration circumferential size.

26. The invention of claim 1 wherein the means of pressure intensification provided for the drilling means comprises open loop stacked gear positive displacement pumps serially boosting imput cutting fluid supplied at low pressure to an output plenum pressure of about 10,000 psi.

27. The invention of claim 26 wherein the open loop stacked series gear pump output pressure is augmented by pulsation reducing and damping means.

28. The invention of claim 1 wherein the control means provides feeding and alignment adjustment by employing reaction jets which receive programed and metered pressurized fluid as a function of photocell signals, the jet total impulse and fluid mass is capable of reacting with the mucking fluid and the walls defining a drilled hole.

29. The invention of claim 1 wherein the control means provide feeding and alignment adjustment by employing pistons which receive programed and metered pressurized fluid as a function of photocell signals and the pistons exert force on the walls defining a drilled hole to align the drill head selectively.

30. The invention of claim 1 wherein fluid is pumped from a surface fluid settling pond as make-up for performing the mucking function, which fluid is supplied directly proportional to the rate of mucking but limited to a level in the hole just below the photocell receiver arrays.

31. The invention of claim 1 wherein a plurality of controlled columnar light sources comprises a leveling means adjustable for a fixed horizontal positioning of the light sources in the drilled hole.

32. The invention of claim 1 wherein the plurality of controlled columnar light sources comprises a leveling means adjustable for a pre-determined fixed non-horizontal positioning of the light sources in the drilled hole.

33. The invention of claim 1 wherein a plurality of controlled columnar light sources comprises lowering means of the light sources to a lower level elevation while maintaining one only of the fixed horizontal positioning of the light sources and the fixed non-horizontal positioning of the light sources in the drilled hole defined by the base.

34. The invention of claim 1 further including a rotating plenum structure means of a cast material of hardness and density capable of resisting material erosion by cutting fluid flow through the structure.

35. The invention of claim 1 further including lift pipes and air injection tubes used as a collection and diversion means for pressurized fluids when such fluids are reached at producing strata and aquifers, the diversion means comprising a relief valve at the pumps which relief valve is energized when the pumps stall because of over-pressurized fluid received through the lift pipes and the relief valve diverting the over-pressurized fluid to storage.

* * * * *